United States Patent [19]

Tachikawa et al.

[11] 4,115,678

[45] Sep. 19, 1978

[54] MICROWAVE OVEN

[75] Inventors: Hajime Tachikawa; Kenji Satoh, both of Yokohama, Japan

[73] Assignee: Hitachi Heating Appliances Co., Ltd., Japan

[21] Appl. No.: 771,914

[22] Filed: Feb. 25, 1977

[30] Foreign Application Priority Data

Feb. 26, 1976 [JP] Japan ..... 51-21957[U]

[51] Int. Cl.[2] ..... H05B 9/06

[52] U.S. Cl. ..... 219/10.55 B; 126/21 A

[58] Field of Search ..... 219/10.55 B, 10.55 F, 219/10.55 D, 10.55 A, 10.55 R, 10.55 M, 400, 411; 126/15 A, 15 R, 21 A, 21 R

[56] References Cited

U.S. PATENT DOCUMENTS

| | | | |
|---|---|---|---|
| 3,185,809 | 5/1965 | Bohm et al. | 219/10.55 B |
| 3,281,568 | 10/1966 | Haagensen | 219/10.55 B |
| 3,407,279 | 10/1968 | Greenberg | 219/10.55 B |
| 3,569,656 | 3/1971 | White | 219/10.55 B |
| 3,716,687 | 2/1973 | Constable | 219/10.55 B |
| 4,028,520 | 6/1977 | Torrey | 219/10.55 B |

*Primary Examiner*—J. V. Truhe
*Assistant Examiner*—Bernard Roskoski
*Attorney, Agent, or Firm*—Craig & Antonelli

[57] ABSTRACT

A microwave oven in which the amount of ventilation for a heating chamber is changed dependent upon whether the heating time is controlled automatically or whether the heating time is controlled by manually setting a timer or a like device, whereby the deposition of dew on the wall of the heating chamber and the obscuring of a viewing panel are prevented.

12 Claims, 5 Drawing Figures

FIG. 5

MICROWAVE OVEN

FIELD OF THE INVENTION

This invention is concerned with preventing the deposition of dew in a high-frequency energy apparatus such as a microwave oven which comprises a control mechanism for the automatic and correct heating of an object raced therein to be heated.

PRIOR ART OF THE INVENTION

As a method for detecting a heated state of an object to be heated to automatically control heating of the object in a high-frequency energy apparatus such as a microwave oven, proposals have conventionally been made as disclosed for example in U.S. Pat. Nos. 3,185,809 and 3,281,568, in which the temperature of air drawn out of a heating chamber or that of air within the heating chamber is sensed to indirectly or relatively measure the temperature of objects to be heated.

Figure 1:
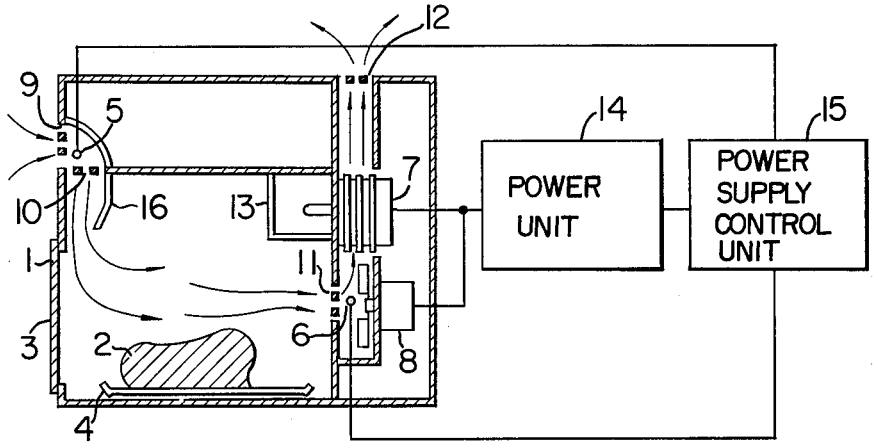
FIG.1 PRIOR ART
FIG. 1 is a schematic diagram of one example of prior art microwave ovens in which the temperature of the air flowing out of the heating chamber is sensed to control the supply of the high-frequency energy.

FIG. 1 illustrates one example of prior art microwave ovens as incorporating the above-mentioned conventional method. The microwave oven of FIG. 1 comprises a heating chamber 1 where an object 2 to be heated is placed on a dish 4, an airtight door 3 normally provided with a viewing panel, an inlet temperature sensor 5 for sensing the temperature of air flowing into the heating chamber 1, an outlet temperature sensor 6 for sensing the temperature of air flowing out of the heating chamber 1, a high-frequency oscillating tube 7 directly coupled to the heating chamber, a cooling fan 8 provided for the high-frequency oscillating tube 7, an air inlet 9 for the microwave oven, an air inlet 10 for the heating chamber, an air outlet 11 for the heating chamber, an air outlet 12 for the microwave oven, a partition plate 13 made of a low high-frequency energy loss material, a power unit 14, and a control unit 15. The sensors 5 and 6 are substantially shielded from the high-frequency energy emitted by the high-frequency oscillating tube 7. Arrows marked on the figure are indicative of the direction of air flow (in the succeeding figure, arrows are depicted for the same purpose).

Figure 2:
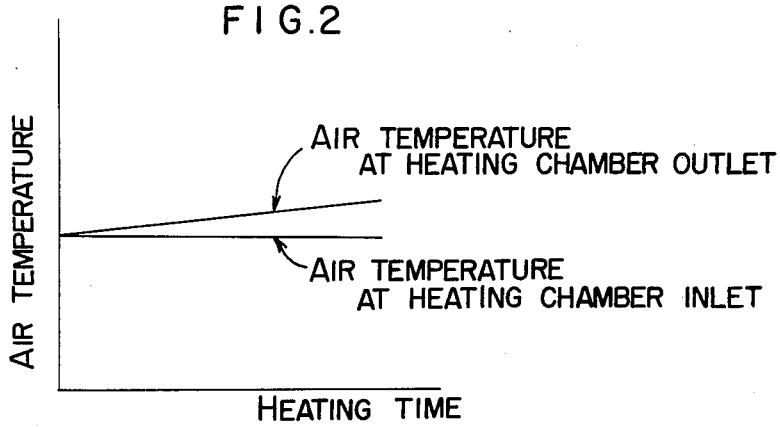
FIG. 2 is a graphical diagram showing the temperature rise characteristics of the air flowing into the heating chamber and that flowing out therefrom in the microwave oven of FIG. 1.

When the power unit 14 is actuated, the high-frequency oscillating tube 7 starts to oscillate to feed high-frequency energy to the heating chamber 1, thereby heating the object 2. The high-frequency oscillating tube cooling fan 8 is also operated in a manner such that external air fed through the microwave oven air inlet 9 is drawn into the heating chamber 1 via the heating chamber air inlet 10, guided by a guide plate 16 and the door 3 to pass through the lower space of the heating chamber 1 while passing around the object 2, drawn out of the heating chamber air outlet 11 exteriorly of the heating chamber 1 to pass through the high-frequency oscillating tube cooling fan 8 while cooling the high-frequency oscillating tube 7 and finally drawn out of the microwave oven air outlet 12. In this circulation of the air, by sensing the temperature of the external air drawn into the heating chamber 1 by means of the inlet temperature sensor 5 and the temperature of the air drawn out of the heating chamber 1 by means of the outlet temperature sensor 6, as shown in FIG. 1, it has been found that, as shown in FIG. 2, the temperature of the air flowing into the heating chamber (i.e., external air) remains substantially constant but the temperature of the air flowing out of the heating chamber gradually rises with the heating time.

The temperature rise of the air flowing out of the heating chamber results from the temperature rise of the air within the heating chamber 1 when the object 2 to be heated is heated by the output energy of the high-frequency oscillating tube 7. Accordingly, it is possible to detect a heated state of the object to be heated by detecting the amount of temperature rise of the air flowing out of the heating chamber (substantially equal to a difference in temperature between the air flowing into the heating chamber and that flowing out therefrom) during heating of the object. Thus, the heating time may automatically be controlled by controlling the power unit 14 which in turn controls the oscillation of the high-frequency oscillating tube 7, by means of the control unit 15 when a detected signal indicative of the amount of the temperature rise of the air flowing out of the heating chamber reaches a predetermined value. In accordance with the conventional microwave oven as shown in FIG. 1, however, in order to enhance the amount of the temperature rise of the air flowing out of the heating chamber due to the heat given off by the object, it was necessary to decrease the amount of ventilation for the heating chamber.

Typically, in the case where the heating time is automatically controlled by sensing the temperature of the air flowing out of the heating chamber, a prolonged heating will not be carried out under a vigorous generation of aqueous vapor (e.g. around a temperature of 100° C. of the object to be heated) from the view point of the prevention of damage of the object due to dehydration thereof or the like cause and hence the supply of the high-frequency energy is stopped or the amount of the high-frequency energy is decreased before such a vigorous generation of aqueous vapor occurs.

Accordingly, in the case of the automatic heat controlling in which, as mentioned above, it is prohibited from the view point of improving controlling accuracies to feed into the heating chamber hot air which has been passed through a heat generating element and in which the generation of aqueous vapor from the object to be heated is slight during heating, the problem of dew deposition will not be encountered even if not only the external air is drawn into the heating chamber but also the amount of ventilation for heating chamber is decreased to enhance the amount of the temperature rise in the air flowing out of the heating chamber.

In contrast thereto, in the case where the heating time is controlled by means of a manually operated control unit such as a timer or the like device, heating continues under a vigorous generation of aqueous vapor from the object to be heated for the timed period. In such a case, if the amount of ventilation for the heating chamber is small, the ability for evacuating aqueous vapor generated is so poor that the aqueous vapor dominantly prevails within the heating chamber 1. This leads to the deposition of dew on the wall of the heating chamber and obscuring of a viewing panel possibly provided for the door 3 of the microwave oven. Thus, the user's good visibility of the object 2 to be heated through the viewing panel is impaired.

SUMMARY OF THE INVENTION

This invention contemplates to obviate the above drawbacks of the prior art and it is a main object of this invention to provide a high-frequency energy apparatus such as a microwave oven with an automatic heating time control mechanism and a manual heating time control mechanism using a timer or the like device in which the deposition of dew on the walls of heating chamber and the obscuring of the viewing panel are prevented.

In accordance with this invention, the above object is accomplished by providing a microwave oven in which the amount of ventilation for a heating chamber is changed depending upon whether the heating time is controlled automatically or whether the heating time is controlled by manually setting a timer or the like device, whereby the deposition of dew on the wall of the heating chamber and the obscuring of a viewing panel are prevented.

Other objects, advantages and effects of this invention will become apparent from the following detailed description taken in conjunction with the accompanying drawings.

DESCRIPTION OF PREFERRED EMBODIMENTS

Figure 3:
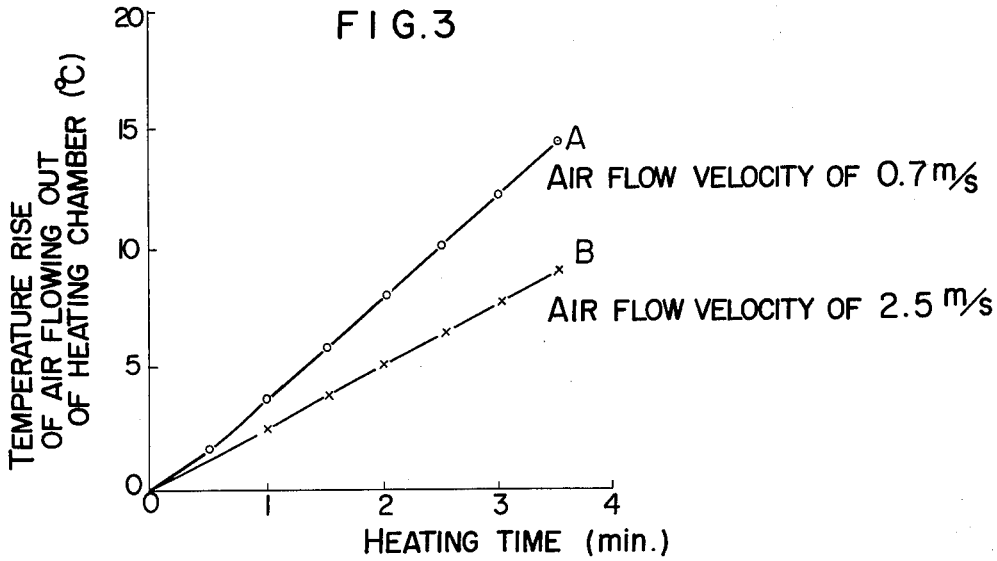
FIG. 3 is a graphical diagram showing the temperature rise characteristics of the air flowing out of the heating chamber as the amount of ventilation for the heating chamber varies.

FIG. 3 shows an example of experimental results of the temperature rise of the air flowing out of the heating chamber obtained under a condition that the velocity of air flow is varied, namely the amount of air drawn out of the heating chamber is varied, maintaining the sectional area of the heating chamber air outlet 11 constant. In FIG. 3, a solid line A is for an air flow velocity of 0.7 m/s and a solid line B for an air flow velocity of 2.5 m/s. It will be seen from FIG. 3 that the temperature rise of the air flowing out of the heating chamber increases as the amount of ventilation decreases. However, the ability to evacuate aqueous vapors given off by the object 2 to be heated decreases with the result that the aqueous vapors largely fill the heating chamber and hence a tendency to deposit dew on the walls of the heating chamber is accelerated. As the amount of ventilation increases, on the other hand, the tendency will be decelerated but the temperature rise of the air flowing out of the heating chamber will be decreased. In the case where the heating time is automatically controlled by sensing the air temperature at the heating chamber outlet, the amount of aqueous vapors given off by the object to be heated during heating is small as described hereinbefore even if the amount of ventilation of the heating chamber is decreased to increase the temperature rise of the air flowing out of the heating chamber in view of improving controlling accuracy and hence the problem of dew deposition will not be encountered. In the case where the heating time is controlled by manually setting a timer or the like device, on the other hand, there is no need for sensing the air temperature at the heating chamber outlet, enabling the amount of ventilation for the heating chamber to be increased. Consequently, the aqueous vapors given off by the object are positively drawn out of the heating chamber by the increased ventilation and the problem of the deposition of dew will not be encountered even if the heating time is prolonged with a rapid generation of the aqueous vapors.

Taking into consideration the above characteristics inherent to the automatic and manual controls of the heating time, in accordance with this invention, the amount of ventilation for the heating chamber is varied depending upon the modes of either automatic or manual control.

Figure 4:
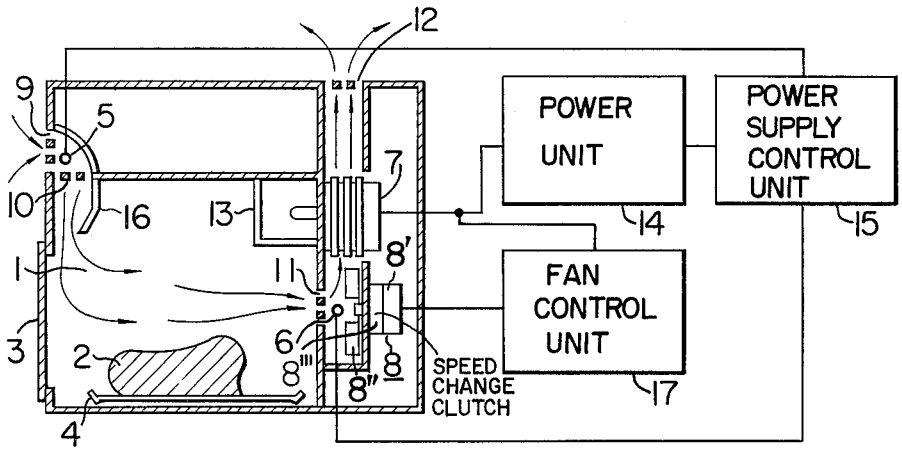
FIGS. 4 and 5 are schematic diagrams of embodiments of this invention.

Referring now to FIG. 4 in which members and units corresponding to those of FIG. 1 are designated by identical reference numerals, according to one embodiment of this invention the amount of ventilation is varied by varying the rotational speed of the fan 8 adapted to ventilate the heating chamber. For this purpose, a control unit 17 is provided for controlling the speed of the electrical-motor-driven fan 8. By the control unit 17, the frequency or voltage of the power supply feeding an electrical motor 8' for driving a blade assembly 8'' of the fan 8 is varied to vary the speed of the fan for ventilating the heating chamber. Alternatively, if the blade assembly 8'' is coupled with the driving motor 8' through a speed change clutch 8, the speed of the fan may be controlled by manipulating the speed change clutch.

Figure 5:
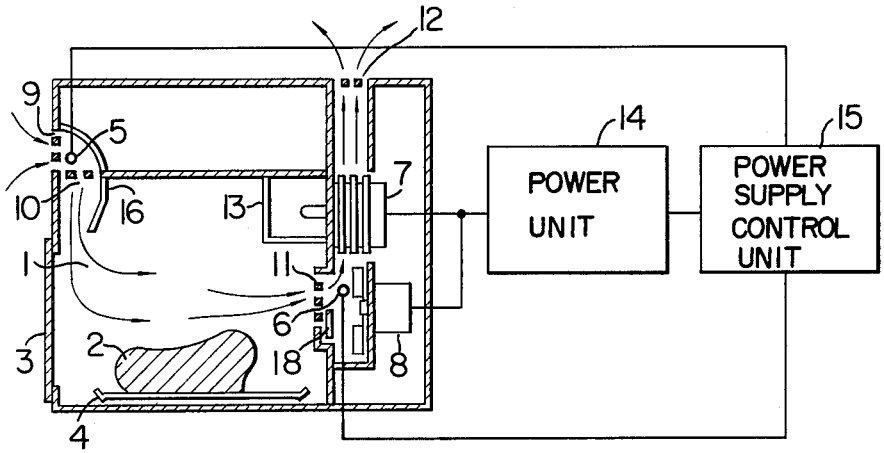

Turning to FIG. 5 in which members and units corresponding to those of FIG. 1 are designated by identical reference numerals, it will be appreciated that according to another embodiment of this invention the amount of ventilation is varied by varying the static pressure at the ventilation path communication with the heating chamber. Specifically, a shutter 18 located at the heating chamber outlet 11 is driven electrically or mechanically to vary the area the apertures formed in the heating chamber outlet 11, thereby varying the amount of ventilation. Obviously, the shutter may be disposed at the heating chamber inlet 10 or oven inlet 9 in place of the heating chamber outlet 11.

It should be noted that, in the foregoing embodiments, the outlet temperature sensor 6 may be replaced by a temperature sensor (not shown) disposed in the heating chamber to detect the temperature of the air within the heating chamber without degrading the effects of this invention.

As has been described, in accordance with this invention, when the heating time is automatically controlled by sensing the temperature of the air flowing out of the heating chamber, the deposition of dew on the walls of the heating chamber and the obscuring of the viewing panel are prevented by stopping the heating before the aqueous vapors given off by the object to be heated prevail dominantly in the heating chamber so that the amount of ventilation for the heating chamber can be decreased to improve accuracy of sensing the temperature of the object to be heated.

On the other hand, when the heating time is controlled by manually setting a timer or the like device, the amount of ventilation for the heating chamber is increased so that the deposition of dew on the wall of the heating chamber may be prevented, eliminating the necessity for wiping off the inner walls of the heating chamber, and the obscuring of the viewing panel are prevented. This leads to the user's good visibility of the object placed in the heating chamber through the viewing panel.

We claim:

1. A microwave oven comprising:

a casing constituting a heating chamber for accommodating an object to be heated;

a high-frequency energy generator operative to generate high-frequency energy and feeding it to said heating chamber;

means for ventilation of air in said heating chamber, said ventilation means including a ventilation path constituted in part by the space of said heating chamber, said high-frequency energy generator being disposed on a part of said ventilation path which is outside of said heating chamber;

first heating time control means for automatically controlling the heating time for an object to be heated, said first heating time control means including temperature sensor means for sensing at least one of temperatures of the air within said heating chamber and of the air drawn out of said heating chamber and means for controlling said high-frequency energy generator to change the amount of supply of the high-frequency energy from said generator when the temperature sensed by said temperature sensor means reaches a predetermined value;

second heating time control means for manually controlling the heating time for an object to be heated;

means for selectively actuating said first and second heating time control means to change the heating time control mode between an automatic and a manual control mode; and means for varying the amount of ventilation achieved by said ventilation means in accordance with the heating time control mode selected by said selectively actuating means.

2. A microwave oven according to claim 1, wherein said ventilation amount viewing means controls the amount of ventilation to a smaller value when the first heating time control means is actuated than when the second heating time control means is actuated.

3. A microwave oven according to claim 2, wherein said ventilation means includes an electrical-motor-driven fan disposed on said ventilation path for controlling air flow through said heating chamber.

4. A microwave oven according to claim 3, wherein said ventilation amount varying means includes means for controlling the rotational speed of said fan.

5. A microwave oven according to claim 4, wherein said fan rotational speed control means includes means for controlling the input frequency to an electrical motor adapted to drive said fan.

6. A microwave oven according to claim 4, wherein said fan rotational speed control means includes means for controlling the input voltage to an electrical motor adapted to drive said fan.

7. A microwave oven according to claim 4, wherein said fan rotational speed control means includes a speed change clutch which couples said fan with an electrical motor adapted to drive said fan.

8. A microwave oven according to claim 2, wherein said ventilation amount varying means includes a shutter disposed on a part of said ventilation path, said shutter being operable to be opened and closed for changing the cross sectional area of said ventilation path at said part.

9. A microwave oven according to claim 3, wherein said ventilation amount varying means includes a shutter disposed on a part of said ventilation path, said shutter being operable to be opened and closed for changing the cross sectional area of said ventilation path at said part.

10. A microwave oven according to claim 1, wherein said ventilation amount varying means controls the amount of ventilation to prevent dew formation on walls of said heating chamber at least during said manual control mode.

11. A microwave oven according to claim 1, wherein said ventilation amount varying means controls the velocity of air flow through said heating chamber in accordance with the heating time control mode selected.

12. A microwave oven according to claim 1, wherein said ventilation amount varying means controls the cross-sectional area of said ventilation path along at least one part thereof in accordance with the heating time control mode selected.

* * * * *